US010494947B2

(12) United States Patent
Murakami et al.

(10) Patent No.: US 10,494,947 B2
(45) Date of Patent: Dec. 3, 2019

(54) OPERATION METHOD FOR STEAM TURBINE, AND STEAM TURBINE

(71) Applicant: MITSUBISHI HITACHI POWER SYSTEMS, LTD., Yokohama (JP)

(72) Inventors: Kenichi Murakami, Yokohama (JP); Mitsuyoshi Tsuchiya, Yokohama (JP); Mamoru Odagawa, Yokohama (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 193 days.

(21) Appl. No.: 15/822,490

(22) Filed: Nov. 27, 2017

(65) Prior Publication Data

US 2018/0149037 A1 May 31, 2018

(51) Int. Cl.

*F01D 17/08* (2006.01)
*F01D 17/14* (2006.01)
*F01D 25/24* (2006.01)

(52) U.S. Cl.

CPC ..... *F01D 17/08* (2013.01); *F01D 17/145* (2013.01); *F01D 25/24* (2013.01); *F05D 2220/31* (2013.01); *F05D 2270/301* (2013.01); *F05D 2270/3011* (2013.01)

(58) Field of Classification Search

CPC . F01D 9/02; F01D 9/047; F01D 17/02; F01D 17/08; F01D 17/145; F01D 25/24; F05D 2220/31; F05D 2270/301; F05D 2270/3011; F05D 2270/3015; F05D 2270/80

See application file for complete search history.

(56) References Cited

U.S. PATENT DOCUMENTS 4,325,670 A * 4/1982 Silvestri, Jr. ..... F01D 17/18 415/1
8,152,446 B2 * 4/2012 Zhang ..... F01D 11/24 415/108
2010/0178153 A1 * 7/2010 Gehringer ..... F01D 17/145 415/1

FOREIGN PATENT DOCUMENTS

JP 6-221106 A 8/1994
JP 2013-204469 A 10/2013
JP 2016-75189 A 5/2016

* cited by examiner

*Primary Examiner* — Jason D Shanske
*Assistant Examiner* — Sang K Kim
(74) *Attorney, Agent, or Firm* — Westerman, Hattori, Daniels & Adrian, LLP

(57) ABSTRACT

A steam turbine include a steam chest casing that is provided with a plurality of nozzle openings along a circumferential direction; a partition wall to partition the steam chest casing into the main steam chest and a sub-steam chest with smaller capacity than the main steam chest; a main steam pipe that supplies steam to the main steam chest; a steam chest connection pipe that distributes part of the steam, which is supplied to the main steam chest, to the sub-steam chest; a steam chest connection valve; a pressure gauge that measures the pressure of the steam flowing in the main steam pipe; and a control unit that closes the steam chest connection valve when the measured pressure is less than more than or equal to a predetermined threshold value, and opens the steam chest connection valve when the measured pressure is less than the predetermined threshold value.

6 Claims, 7 Drawing Sheets

OPERATION METHOD FOR STEAM TURBINE, AND STEAM TURBINE

CROSS-REFERENCE TO RELATED APPLICATIONS

This application is based on Japanese Patent Application No. 2016-230227, the contents of which are incorporated herein by reference in its entirety.

TECHNICAL FIELD

The present invention relates to an operation method for a steam turbine, and a steam turbine.

BACKGROUND ART

In a geothermal turbine plant, when the state of hot water or steam of a geothermal well corresponding to a steam supply source changes, a main steam pressure after flashing the steam or the hot water supplied from the geothermal well varies. Therefore, it is necessary to adjust the pressure of the steam to be supplied to the steam turbine so as to be a predetermined pressure in accordance with the main steam pressure.

In the nozzle governing type geothermal turbine according to Patent Literatures 1 and 2 below, the inside of an annular steam chest provided with the first stage nozzle is partitioned by a plurality of partition walls into one main steam chest with large capacity and one or a plurality of sub-steam chests with small capacity, and the one sub-steam chest or the plurality of sub-steam chests can be opened or closed individually. A steam chest connection pipe that supplies steam to the sub-steam chest is branched from a main steam pipe that supplies steam to the main steam chest, and the steam with the same pressure is supplied to the main steam chest and the sub-steam chest.

In the techniques according to Patent Literatures 1 and 2, when the output of the turbine has dropped to cause the sub-steam chest to operate, the first stage nozzle of the main steam chest where the impurities are deposited has the smaller opening area, and the first stage nozzle of the sub-steam chest where the impurities are not deposited has the large opening area. When the steam with the same pressure is supplied to the first stage nozzle in the main steam chest and the sub-steam chest with the different opening areas, the amount of steam (the pressure of steam) to flow from only the sub-steam chest into the initial-stage turbine is increased.

In the technique described in Patent Literatures 1 and 2, the uniform steam supply along the circumferential direction of the initial-stage turbine may fail. Therefore, in view of this, Patent Literature 3 below discloses the technique in which the steam can be supplied uniformly along the circumferential direction of the initial-stage turbine from both the first stage nozzle of the main steam chest and the sub-steam chest when the sub-steam chest is in operation.

CITATION LIST

Patent Literature

{PTL 1} Japanese Unexamined Patent Application, Publication No. Hei6-221106

{PTL 2} Japanese Unexamined Patent Application, Publication No. 2013-204469

{PTL 3} Japanese Unexamined Patent Application, Publication No. 2016-75189

SUMMARY OF INVENTION

Technical Problem

On the upstream side of the first stage nozzle that supplies steam to the initial-stage rotor of the steam turbine, a governing valve (GV) is provided to adjust the steam flow rate. In consideration of the steam condition at the low pressure when a main steam pressure has decreased due to, for example, the influence from the geothermal well as described above, the amount of opening the GV is increased so that the steam to be supplied to the steam turbine at the low pressure has a predetermined pressure. Under a condition in which the main steam pressure is high, it is necessary to largely narrow the opening of the GV as illustrated in FIG. 7 in order to make the steam to be supplied to the steam turbine have the predetermined pressure, and therefore, the steam flow rate does not increase as expected despite the increase in the main steam pressure. For this reason, as shown by a dash-dot line in FIG. 6, even though there is the main steam pressure that is originally high, the pressure loss due to the narrowing of the opening of the GV lowers the output of the turbine. That is to say, if the pressure of the steam to be supplied to the turbine is increased, the heat drop is increased and therefore, the turbine output is supposed to increase. However, even in the condition where the main steam pressure is high, narrowing the opening of the GV causes the pressure loss in the GV, so that the increase in turbine output is suppressed.

The present invention has been made in view of such a circumstance, and an object is to provide an operation method for a steam turbine, and a steam turbine, in which when the main steam pressure varies, and therefore the steam flow rate is adjusted, the pressure loss due to the governing valve is suppressed so as to increase the efficiency of converting into the turbine output.

Solution to Problem

In order to achieve the above object, an operation method for a steam turbine, and a steam turbine according to the present invention provide the following solutions.

An operation method for a steam turbine according to an aspect of the present invention is an operation method for a steam turbine including: a steam chest casing that has an annular shape surrounding a turbine rotor and is provided with a plurality of nozzle openings along a circumferential direction thereof; a main steam chest that is provided inside the steam chest casing; at least one sub-steam chest that is provided inside the steam chest casing and has smaller capacity than the main steam chest; a partition wall that is provided inside the steam chest casing to partition the steam chest casing into the main steam chest and the sub-steam chest; a main steam pipe that supplies steam to the main steam chest; a steam chest connection pipe that connects the main steam chest and the sub-steam chest and distributes part of the steam, which is supplied to the main steam chest, to the sub-steam chest; and a steam chest connection valve that is provided to the steam chest connection pipe, the operation method including: a step of measuring pressure of the steam flowing in the main steam pipe; a step of closing the steam chest connection valve when the measured pressure of the steam is more than or equal to a predetermined threshold value; and a step of opening the steam chest connection valve when the measured pressure of the steam is less than the predetermined threshold value.

In this configuration, when the pressure of the steam flowing in the main steam pipe is more than or equal to a predetermined threshold value, the steam chest connection valve provided to the steam chest connection pipe connecting the main steam chest and the sub-steam chest is closed; therefore, the passing area of the steam chest becomes narrower. As a result, even when the main steam pressure is high, the pressure of the steam to be supplied to the entrance of the nozzle opening can be adjusted by the passing area so that the steam pressure is in the predetermined range.

On the other hand, when the pressure of the steam flowing in the main steam pipe is less than the predetermined threshold value, the steam chest connection valve provided to the steam chest connection pipe is opened; therefore, the passing area of the steam chest becomes larger. As a result, even when the main steam pressure is low, the pressure of the steam to be supplied to the entrance of the nozzle opening can be adjusted by the passing area so that the steam pressure at the entrance of the nozzle opening is in the predetermined range.

Thus, the pressure of the steam to be supplied to the nozzle opening can be adjusted depending on whether to supply the steam to the sub-steam chest while suppressing the pressure loss by narrowing as little as possible the opening of the governing valve provided to the main steam pipe. Therefore, the pressure loss caused in the governing valve can be reduced and the efficiency of converting into the turbine output can be increased.

In the above aspect of the present invention, the at least one sub-steam chest may include a plurality of sub-steam chests partitioned into by the partition wall, the steam chest connection pipe may be one of a plurality of steam chest connection pipes that connects each sub-steam chest and the main steam chest, the steam chest connection valve may be one of a plurality of steam chest connection valves that is provided to the plurality of steam chest connection pipes, and the one steam chest connection valve or the plurality of steam chest connection valves may be opened and closed in accordance with the measured pressure of the steam.

In this configuration, the plurality of sub-steam chests is formed, and moreover the plurality of steam chest connection pipes is provided to connect the main steam chest and the sub-steam chests, and the plurality of steam chest connection valves is provided to the steam chest connection pipes. Thus, the passing area of the steam chest can be changed in three or more stages. Therefore, depending on the condition of the main steam pressure, the steam pressure can be adjusted by changing the pressure of the steam to be supplied to the entrance of the nozzle opening in stages, specifically in three or more stages, while suppressing the pressure loss by narrowing the opening of the governing valve as little as possible. Thus, the range of the main steam pressure to make the steam to be supplied to the entrance of the nozzle opening have the pressure in the predetermined range can be set widely, and by reducing the pressure loss caused in the governing valve, the efficiency of converting into the turbine output can be increased.

In the above aspect of the present invention, a governing valve provided to the main steam pipe that supplies the steam may adjust the pressure of the steam at an entrance of the plurality of nozzle openings to be pressure in a predetermined range.

In this configuration, the steam pressure at the entrance of the nozzle openings is adjusted to be in the predetermined range by the governing valve provided to the main steam pipe.

A steam turbine according to an aspect of the present invention includes: a steam chest casing that has an annular shape surrounding a turbine rotor and is provided with a plurality of nozzle openings along a circumferential direction thereof; a main steam chest that is provided inside the steam chest casing; at least one sub-steam chest that is provided inside the steam chest casing and has smaller capacity than the main steam chest; a partition wall that is provided inside the steam chest casing to partition the steam chest into the main steam chest and the sub-steam chest; a main steam pipe that supplies steam to the main steam chest; a steam chest connection pipe that connects the main steam chest and the sub-steam chest and distributes part of the steam, which is supplied to the main steam chest, to the sub-steam chest; a steam chest connection valve that is provided to the steam chest connection pipe; a pressure gauge that measures pressure of the steam flowing in the main steam pipe; and a control unit that closes the steam chest connection valve when the pressure of the steam measured using the pressure gauge is more than or equal to a predetermined threshold value, and opens the steam chest connection valve when the measured pressure of the steam is less than the predetermined threshold value.

A steam turbine according to an aspect of the present invention includes: a steam chest casing that has an annular shape surrounding a turbine rotor and is provided with a plurality of nozzle openings along a circumferential direction thereof; a main steam chest that is provided inside the steam chest casing; at least one sub-steam chest that is provided inside the steam chest casing and has smaller capacity than the main steam chest; a partition wall that is provided inside the steam chest casing to partition the steam chest casing into the main steam chest and the sub-steam chest; a main steam pipe that supplies steam to the main steam chest; a steam chest connection pipe that connects the main steam chest and the sub-steam chest and distributes part of the steam, which is supplied to the main steam chest, to the sub-steam chest; a steam chest connection valve that is provided to the steam chest connection pipe; and a closing plate that is provided to the nozzle opening to close the nozzle opening, wherein the partition wall is set at a predetermined angle intersecting with a plate surface of the closing plate.

In this configuration, in the case where the partition wall is provided, providing the closing plate to the nozzle opening prevents the steam from leaking to the sub-steam chest from the next main steam chest through the nozzle opening, and the steam is supplied to the turbine blade.

Advantageous Effects of Invention

According to the present invention, when the main steam pressure varies and therefore the steam flow rate is adjusted, the pressure loss due to the governing valve can be reduced and the efficiency of converting into the turbine output can be increased.

DESCRIPTION OF EMBODIMENT

An embodiment according to the present invention will hereinafter be described with reference to the drawings.

Figure 1:
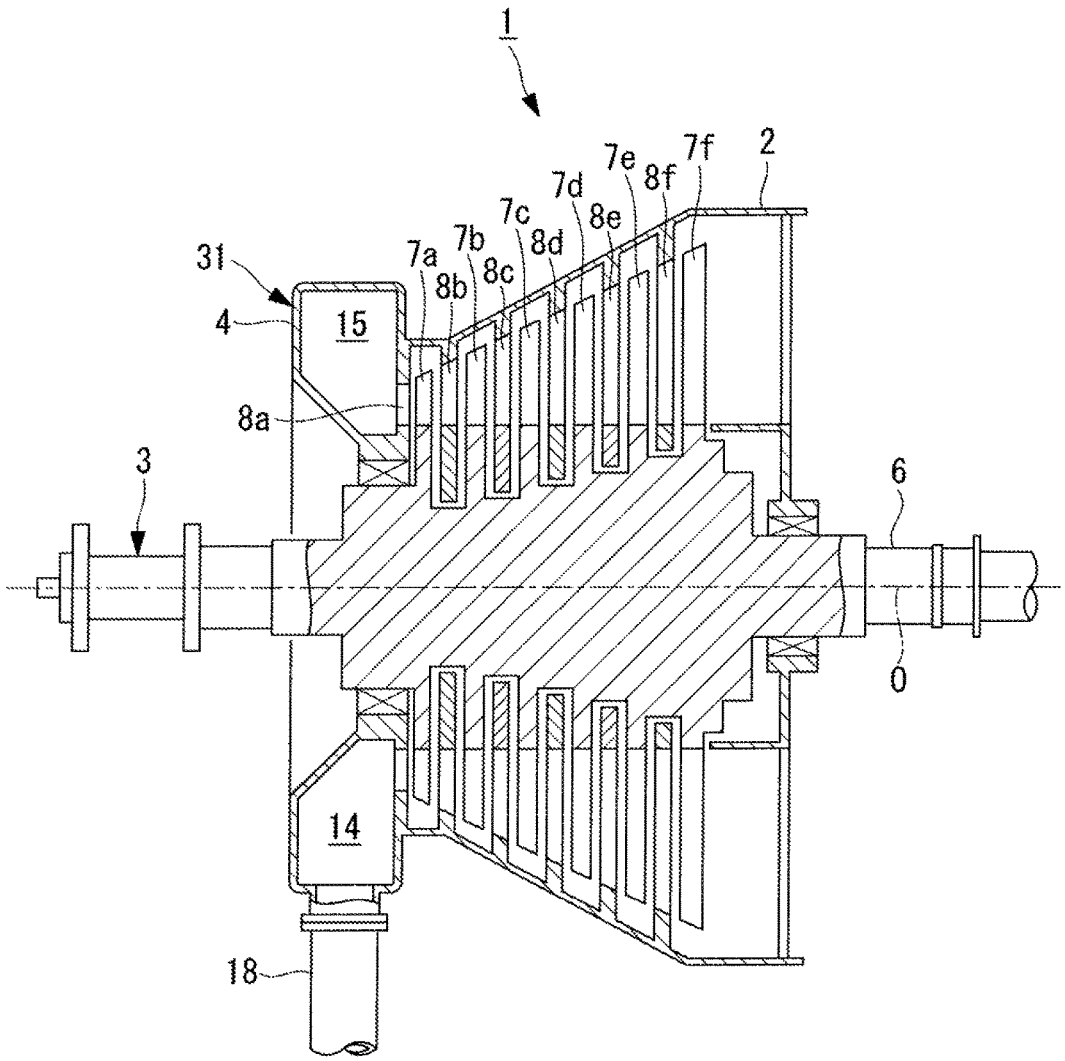
FIG. 1 is a longitudinal cross-sectional view illustrating a geothermal turbine according to an embodiment of the present invention.

A geothermal turbine 1 according to an embodiment of the present invention is to rotate and drive a generator, which is not shown in drawings, in a power plant, for example. As illustrated in FIG. 1, in the geothermal turbine 1, a turbine rotor 3 is supported inside a turbine casing 2 with a shape like a truncated cone, a steam chest casing 4 is installed at one end of the turbine casing 2, and a main steam pipe 18 is connected to the steam chest casing 4.

As illustrated in FIG. 1, the turbine rotor 3 is configured to have turbine blades 7 in multiple stages (in this embodiment, 7*a* to 7*f*) on a turbine shaft 6 so that the turbine blades 7 can rotate together. The turbine blade 7*a* closest to the steam chest casing 4 corresponds to an initial-stage turbine. The turbine blades 7*a* to 7*f* have larger diameters in the order from 7*a* to 7*f*.

On the other hand, on the inner peripheral surface of the turbine casing 2, nozzle openings 8*a* to 8*f* in multiple stages are provided overlapping respectively with the turbine blades 7*a* to 7*f* on the upstream side of the steam flow, and the nozzle opening 8*a* closest to the steam chest casing 4 corresponds to a first stage nozzle. The opening area of the nozzle openings 8*a* to 8*f* increases in the order from 8*a* to 8*f*, and the nozzle openings 8*a* to 8*f* respectively overlap with the blade parts of the turbine blades 7*a* to 7*f* on the upstream side of the steam flow.

Figure 2:
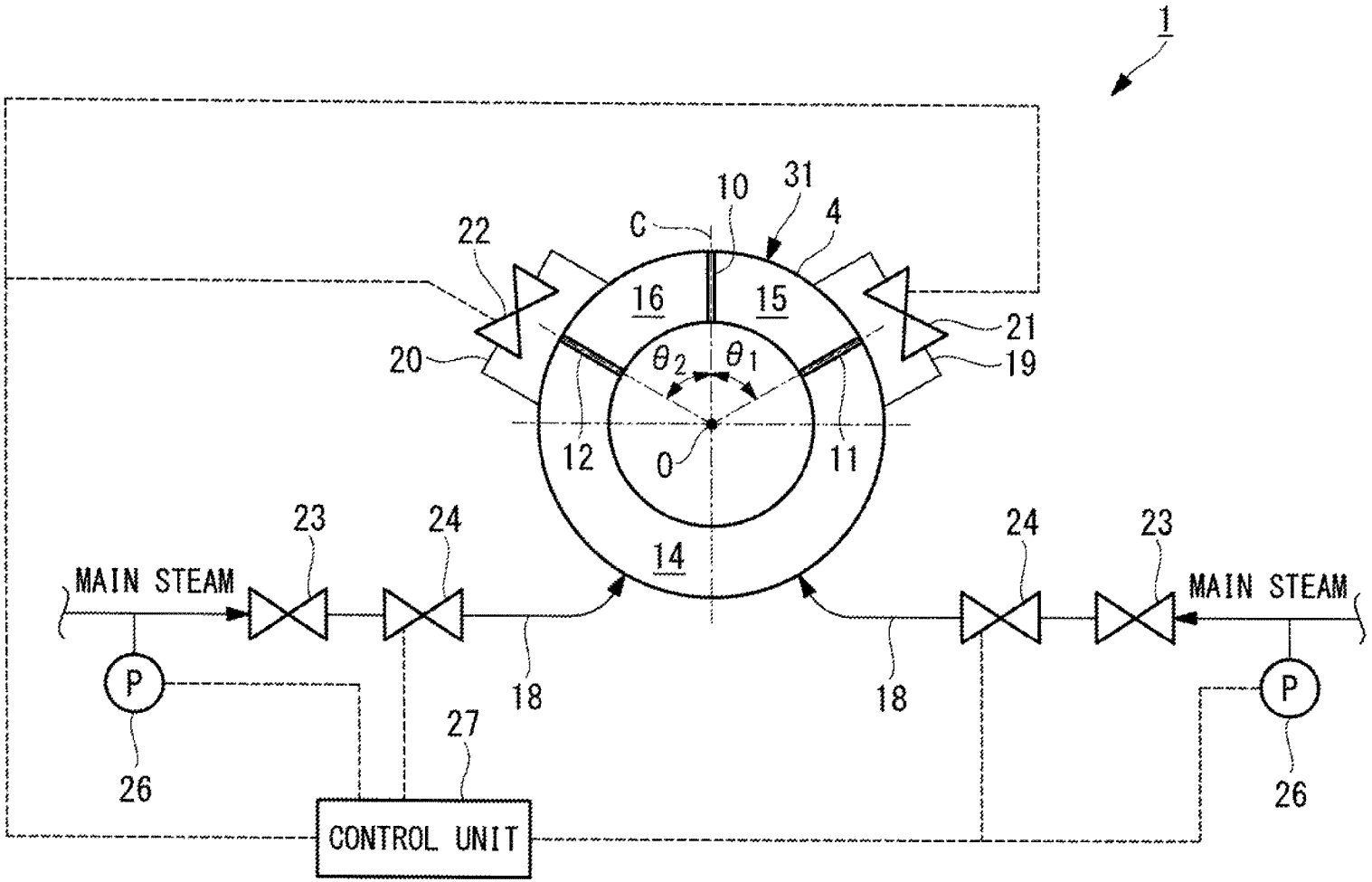
FIG. 2 is a schematic longitudinal cross-sectional view illustrating a steam chest casing of the geothermal turbine according to the embodiment of the present invention, and a schematic configuration diagram of the geothermal turbine.
Figure 3:
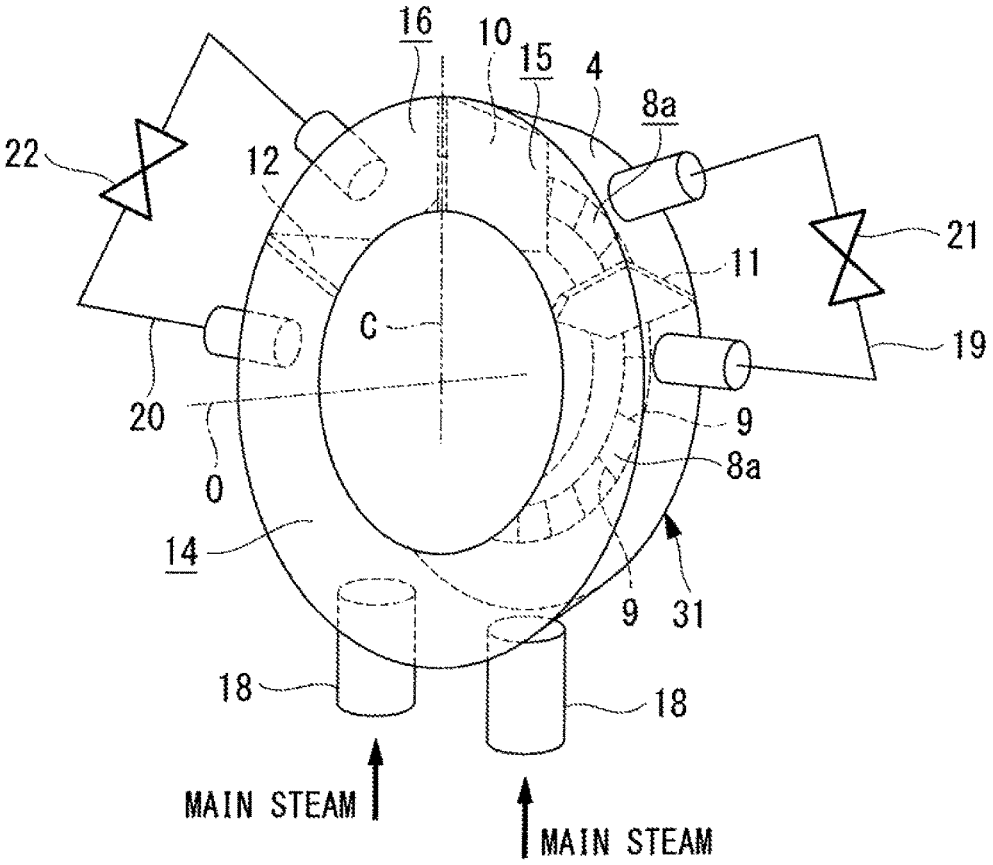
FIG. 3 is a perspective view illustrating the steam chest casing of the geothermal turbine according to the embodiment of the present invention.

As illustrated in FIG. 1 to FIG. 3, the steam chest casing 4 has an annular shape that surrounds the turbine rotor 3 (turbine shaft 6). The first stage nozzles 8*a* are formed along the circumferential direction of the turbine rotor 3. The rotating direction of the turbine rotor 3 (turbine shaft 6) in which an axial line O serves as a center coincides with the clockwise direction in FIG. 2.

A steam chest 31 includes the steam chest casing 4, partition walls 10, 11, and 12, a main steam chest 14, a first sub-steam chest 15, and a second sub-steam chest 16. The steam chest 31 is provided with a main steam pipe 18, a first steam chest connection pipe 19, a second steam chest connection pipe 20, a first steam chest connection valve 21, a second steam chest connection valve 22, a main steam stop valve 23, and a governing valve (GV) 24.

The inside of the steam chest casing 4 is partitioned by, for example, three flat-plate partition walls 10, 11, and 12. Thus, the steam chest casing 4 is divided into the main steam chest 14 with large capacity, and the first sub-steam chest 15 and the second sub-steam chest 16 with the capacity smaller than that of the main steam chest 14. The main steam chest 14 is formed between the partition wall 11 and the partition wall 12, the first sub-steam chest 15 is formed between the partition wall 10 and the partition wall 11, and the second sub-steam chest 16 is formed between the partition wall 10 and the partition wall 12.

In the present embodiment, the partition wall 10 is provided near the uppermost part in the steam chest casing 4 in the vertical direction. The partition walls 11 and 12 are fixed at predetermined positions in the circumferential direction of the steam chest casing 4. When viewed in the axial direction of the turbine rotor (see FIG. 2), the partition wall 11 forms an angle $\theta_1$ in the rotating direction of the turbine rotor 3 (clockwise in FIG. 2) from the vertical center line C passing the axial line O of the turbine shaft 6, and the partition wall 12 forms an angle $\theta_2$ in the opposite direction (counterclockwise in FIG. 2) from the vertical center line C. The capacity ratio among the main steam chest 14, the first sub-steam chest 15, and the second sub-steam chest 16 is determined in accordance with the specification of the geothermal turbine 1 or a method of controlling the steam flow rate to be described below. Based on the determined capacity ratio, the angles $\theta_1$ and $\theta_2$ to define the partition walls 10, 11, and 12 are also determined.

Figure 4:
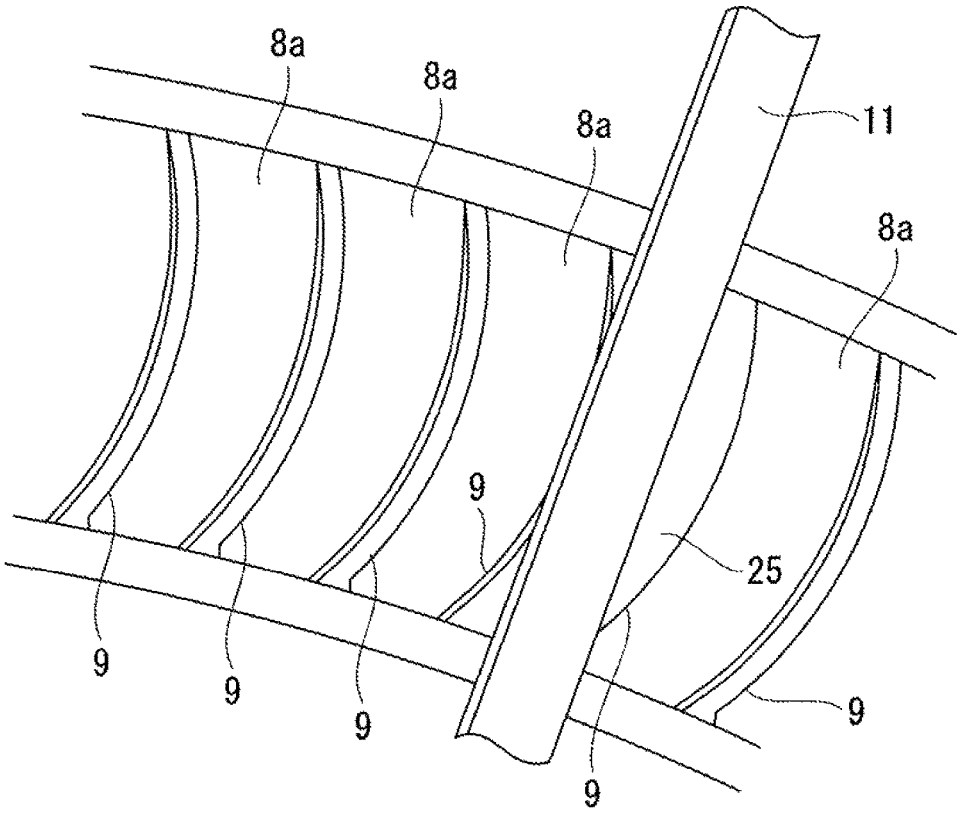
FIG. 4 is a perspective view illustrating nozzle openings, a partition wall, and a closing plate of the geothermal turbine according to the embodiment of the present invention.

The nozzle opening 8*a* is formed between two adjacent blades 9 as illustrated in FIG. 4. Thus, the nozzle opening 8*a* held between the two blades 9 has not the fan shape as schematically illustrated in FIG. 3 but, to be precise, the curved shape as illustrated in FIG. 4. Therefore, if the flat-plate partition walls 10, 11, and 12 are set in the steam chest 31 so that the plate surfaces of the flat-plate partition walls 10, 11, and 12 become parallel with respect to the radial direction of the steam chest 31, the nozzle opening 8*a* is formed so that a closing plate 25 is set at an entrance part of the nozzle opening 8*a* to close at least one nozzle opening 8*a*. The closing plate 25 has a curved shape in accordance with the shape of the entrance part of the nozzle opening 8*a* as illustrated in FIG. 4 and is bonded by welding or the like. The partition walls 10, 11, and 12 are set so that the plate surface of each of the partition walls 10, 11, and 12 has a predetermined angle, for example perpendicular, to the plate surface of the closing plate 25, and are fixed by welding or the like. The predetermined angle is the angle in a direction where the plate surface intersects with the plate surface of the closing plate 25, and the angle at which the interference with the internal structure of the steam chest 31 does not occur is selected and the angle is more preferably perpendicular. The plate surface of each of the partition walls 10, 11, and 12 is parallel to the rotation shaft of the turbine rotor 3, and parallel to the radial direction of the steam chest 31.

In the case where the partition walls 10, 11, and 12 are set as described above, the closing plate 25 is set at the entrance part of the nozzle opening 8*a*. This prevents the steam from leaking to the first sub-steam chest 15 or the second sub-steam chest 16 from the next main steam chest 14 through the nozzle opening 8*a*, and thus, the steam can be supplied to the turbine blade 7*a* of the initial-stage turbine. On the other hand, if the closing plate 25 is not provided, the steam leaks to the first sub-steam chest 15 or the second sub-steam chest 16 from the adjacent main steam chest 14 through the nozzle opening 8*a* because the nozzle opening 8*a* has the curved shape and the partition walls 10, 11, and 12 have the flat-plate shape. The leakage of steam makes it impossible to adjust the flow rate accurately so that the steam to be supplied to the turbine blade 7*a* (the exit of the nozzle opening 8*a*) has the pressure in a predetermined range, resulting in the risk of the decrease in the turbine output. In particular, the leakage occurs easily when the first and second steam chest connection valves 21 and 22 are closed. On the other hand, in the present embodiment, even if the first and second steam chest connection valves 21 and 22 are closed, the steam does not leak to the first sub-steam chest 15 or the second sub-steam chest 16 from the next main steam chest 14 because the closing plate 25 is set, and thus, the decrease in the turbine output is suppressed. In addition, the plate surfaces of the partition walls 10, 11, and 12 are fixed by the closing plate 25, and this structure is simple and preferable.

As illustrated in FIG. 2, the main steam obtained by flashing the geothermal steam or the geothermal hot water is supplied to the main steam chest 14. In the present embodiment, for example, two main steam pipes 18 are connected to the main steam chest 14. The main steam pipes 18 are formed by branching one pipe, which is not shown, into two pipes uniformly at the upstream part. One of the main steam pipes 18 is connected to one side of the main steam chest 14 and the other main steam pipe 18 is connected to the other side of the main steam chest with the turbine shaft 6 interposed therebetween when viewed in the axial direction of the turbine shaft 6 (see FIG. 2). In addition, the main seam pipes 18 are set axial-symmetrically along the vertical center line C passing the axial line O so that the main steam is supplied as uniformly as possible to the first stage nozzle 8*a* provided along the circumferential direction of the main steam chest 14. Note that although the two main steam pipes 18 are connected in the present embodiment, for example, one main steam pipe 18 may be provided in accordance with the specification of the geothermal turbine 1.

Between the main steam chest 14 and the first sub-steam chest 15, the first steam chest connection pipe 19 is disposed to connect the main steam chest 14 and the first sub-steam chest 15. The first steam chest connection pipe 19 is the pipe to distribute part of the main steam, which is supplied from the main steam pipe 18 to the main steam chest 14, to the first sub-steam chest 15 and the first steam chest connection pipe 19 is provided with the first steam chest connection valve 21. The first steam chest connection valve 21 switches to supply or stop the steam through the first steam chest connection pipe 19.

Between the main steam chest 14 and the second sub-steam chest 16, the second steam chest connection pipe 20 is disposed to connect the main steam chest 14 and the second sub-steam chest 16. The second steam chest connection pipe 20 is the pipe to distribute part of the main steam, which is supplied from the main steam pipe 18 to the main steam chest 14, to the second sub-steam chest 16 and the second steam chest connection pipe 20 is provided with the second steam chest connection valve 22. The second steam chest connection valve 22 switches to supply or stop the steam through the second steam chest connection pipe 20.

The first and second steam chest connection valves 21 and 22 are preferably capable of opening and closing for sure with a structure that is as easy and simple as possible so that the influence from the scale in the main steam based on the geothermal steam or the geothermal hot water does not cause any trouble in the opening and closing operation.

The main steam pipe 18 is provided with the main steam stop valve 23 and the governing valve (GV) 24 from the upstream side. The main steam stop valve 23 switches to supply or stop the steam. The GV 24 adjusts the flow rate of the main steam flowing in the main steam pipe 18. Although the main steam is supplied at rated pressure, a main steam pressure may decrease due to the influence of the geothermal well or the like. In view of this, the main steam pipe 18 is provided with a pressure gauge 26 to measure the pressure of the main steam flowing in the main steam pipe 18. The data related to the measured values of the main steam pressure are sent to a control unit 27.

When the main steam pressure has decreased, in order to increase the efficiency of converting into the turbine output by suppressing the decrease in output of the geothermal turbine 1, the flow rate is adjusted in the flow channel of the main steam so that the steam to be supplied to the entrance of the nozzle opening 8*a* has the pressure in the predetermined range. Note that the pressure in the predetermined range is the pressure set to improve the turbine output when the main steam pressure has decreased due to, for example, the influence of the geothermal well. The pressure in the predetermined range is set by adjusting the opening to such a degree that the pressure loss is not caused while narrowing the GV 24 as little as possible. The pressure in the predetermined range can be changed as appropriate depending on the geothermal steam condition or the demanded power.

If the pressure variation of the main steam is small and not sudden, the pressure may be monitored using the pressure gauge 26 and the control unit 27, and then, based on the comparison between the measured main steam pressure and a predetermined threshold value, an operator may open or close each of the first and second steam chest connection valves 21 and 22 in accordance with a predetermined procedure.

On the other hand, instead of the operator, the operation of the first and second steam chest connection valves 21 and 22 may be automatically performed by the instruction from the control unit 27. In this case, the control unit 27 controls to open and close the first and second steam chest connection valves 21 and 22 in accordance with the measured main steam pressure. The operation by the control unit 27 is achieved by executing programs that are stored in advance by the hardware such as a CPU, and if the pressure variation of the main steam is large or occurs suddenly, the operation by the control unit 27 is more preferable.

When the measured main steam pressure is more than or equal to a predetermined threshold value, the control unit 27 closes the first and second steam chest connection valves 21 and 22, and when the measured main steam pressure is less than the predetermined threshold value, the control unit 27 opens the first and second steam chest connection valves 21 and 22. Thus, the passing area of the steam chest 31 is changed. That is to say, when the pressure of the steam flowing in the main steam pipe 18 is more than or equal to the predetermined threshold value, the first and second steam chest connection valves 21 and 22 provided to the first and second steam chest connection pipes 19 and 20 connecting the main steam chest 14 and the first and second sub-steam chests 15 and 16 are closed, so that the passing area of the steam chest 31 becomes small. Therefore, even if the main steam pressure is high, the pressure of the steam to be supplied to the entrance of the nozzle opening 8*a* is adjusted by narrowing the passing area of the steam chest 31 while narrowing the opening of the GV 24 as little as possible, and thus, the steam pressure can be set to the pressure in the predetermined range.

On the other hand, if the pressure of the steam flowing in the main steam pipe 18 is less than the predetermined threshold value, at least one of the first and second steam chest connection valves 21 and 22 provided to the first and second steam chest connection pipes 19 and 20 is opened, so that the passing area of the steam chest 31 becomes larger. For this reason, even if the main steam pressure is low, the pressure of the steam to be supplied to the entrance of the nozzle opening 8*a* is adjusted by expanding the passing area of the steam chest 31 while narrowing the opening of the GV 24 as little as possible, and thus, the steam pressure can be set to the pressure in the predetermined range.

Figure 5:
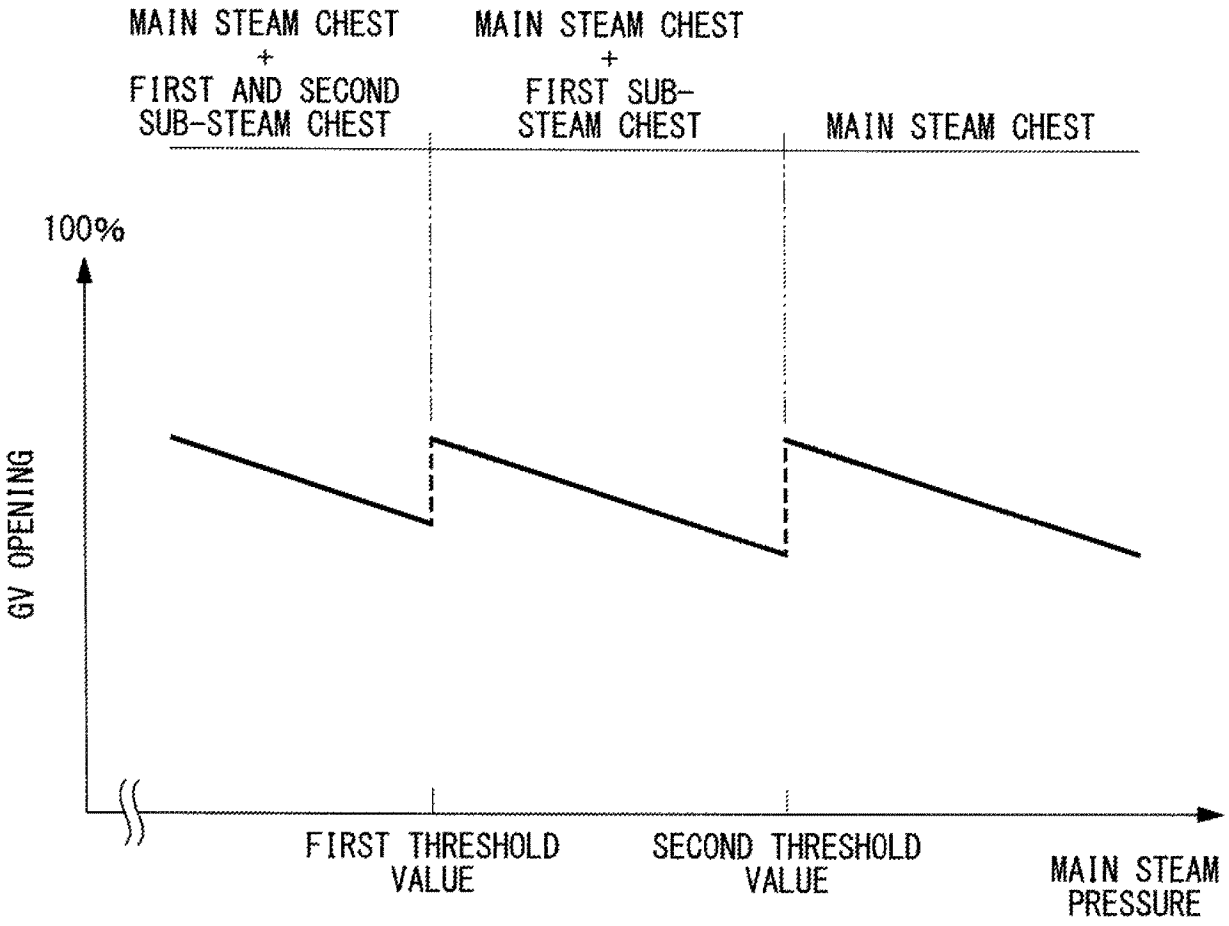
FIG. 5 is a graph illustrating the relation between the GV opening and a main steam pressure according to the embodiment of the present invention.
Figure 6:
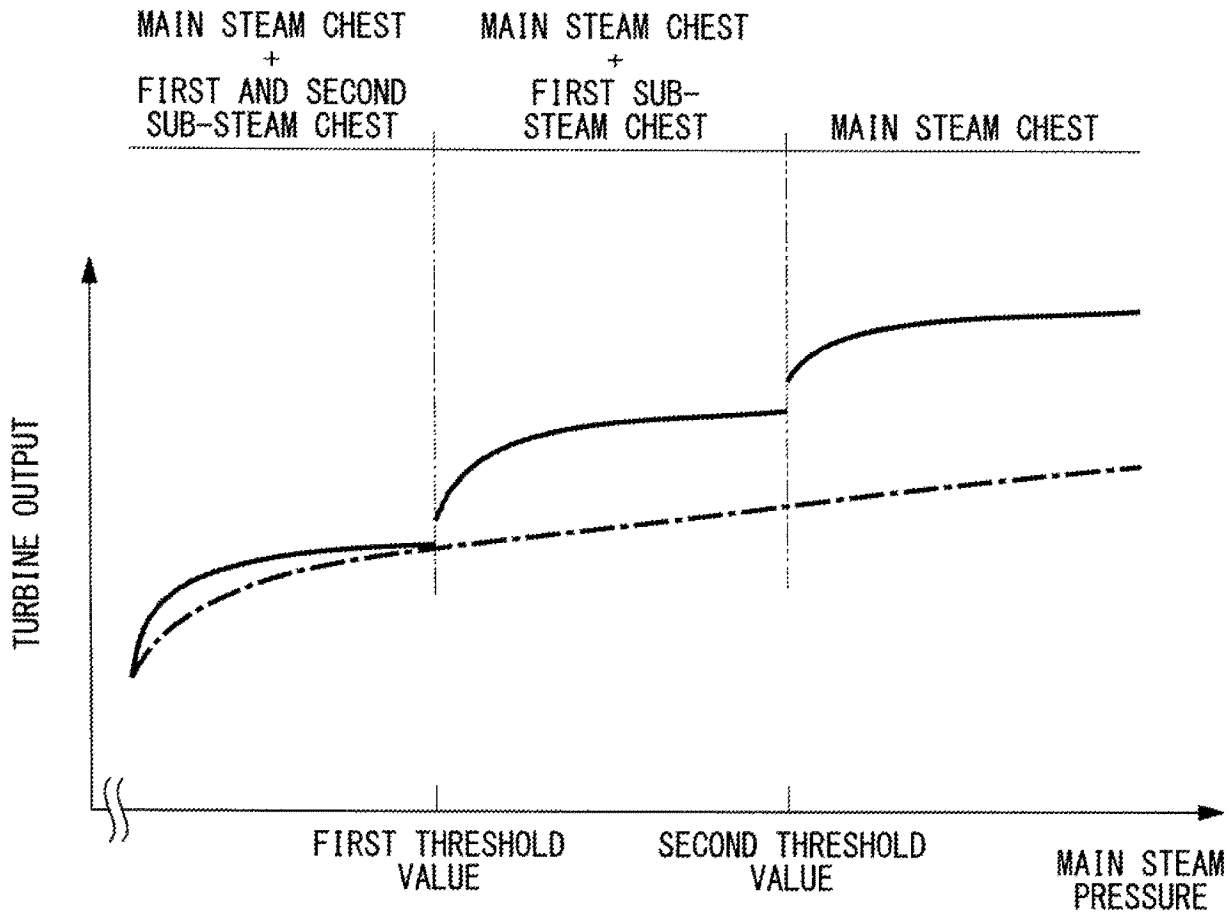
FIG. 6 is a graph illustrating the relation between the turbine output and the main steam pressure according to the embodiment of the present invention.
Figure 7:
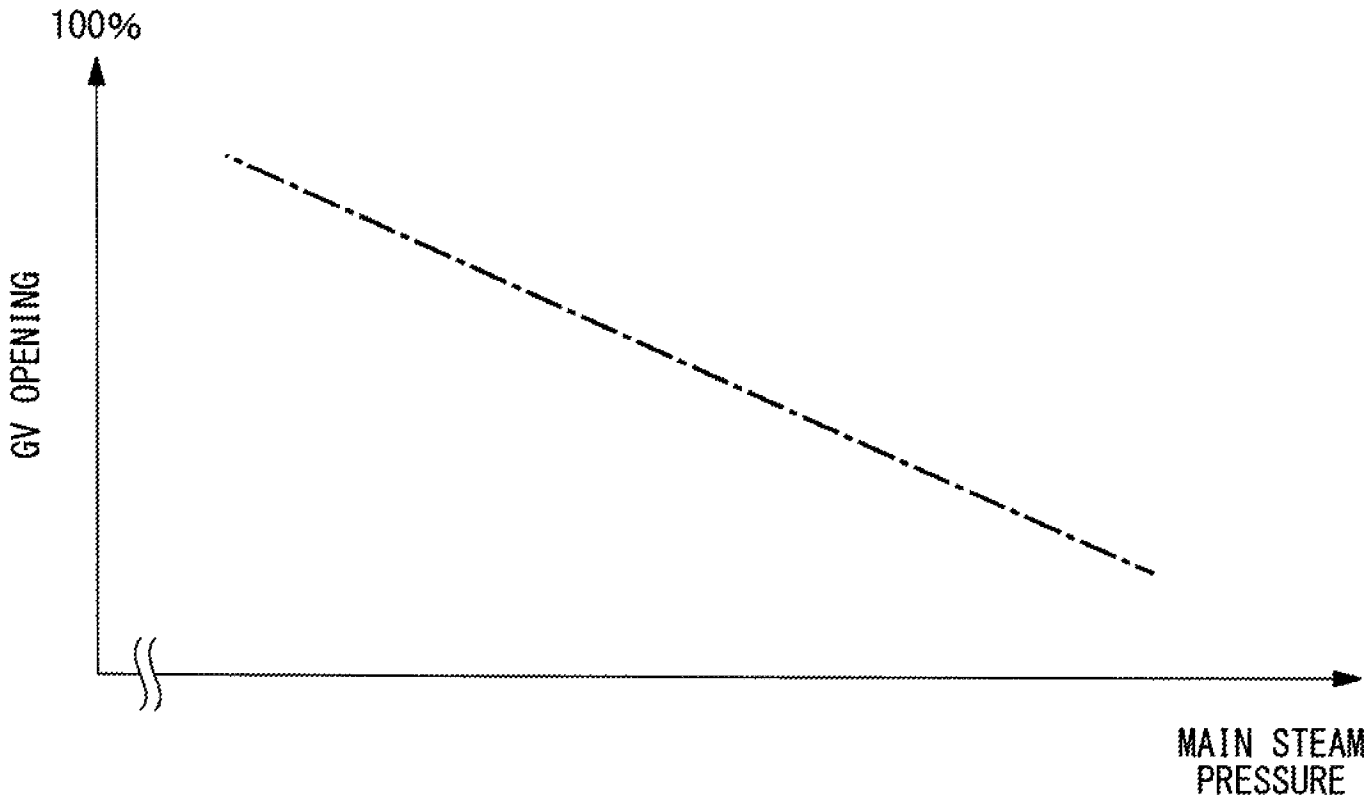
FIG. 7 is a graph illustrating the conventional relation between the main steam pressure and the GV opening to supply the steam to the steam turbine at a predetermined pressure.

Thus, as illustrated in FIG. 5, the pressure of the steam to be supplied to the entrance of the nozzle opening 8*a* can be adjusted not just by opening or closing the GV 24 provided to the main steam pipe 18 but also by supplying or stopping the steam to the first and second sub-steam chests 15 and 16. Therefore, since the opening of the GV 24 is narrowed as little as possible, the pressure loss caused in the GV 24 can be reduced and the turbine output relative to the main steam pressure can be increased as shown by the solid lines in FIG. 6; accordingly, the efficiency of converting into the turbine output can be improved.

Next, a flow rate control method for the geothermal turbine 1 according to the present embodiment is described.

In the method described below, two different threshold values of a first threshold value and a second threshold value are provided in regard to the main steam pressure, and the passing area of the steam chest 31 is changed in three stages. Note that the second threshold value is larger than the first threshold value.

The main steam is supplied at the rated pressure; however, the main steam pressure may vary due to the influence of the geothermal well or the like. When the main steam pressure measured using the pressure gauge 26 is more than or equal to the second threshold value, both the first steam chest connection valve 21 and the second steam chest connection valve 22 are closed. Since the first steam chest connection valve 21 provided to the first steam chest connection pipe 19 and the second steam chest connection valve 22 provided to the second steam chest connection pipe 20 are closed, the supply of steam from the main steam chest 14 to both the first sub-steam chest 15 and the second sub-steam chest 16 is stopped. As a result, the steam chest 31 that the steam can pass is only the main steam chest 14.

When the main steam pressure measured using the pressure gauge 26 is in the range of more than or equal to the second threshold value and the main steam pressure varies, the pressure of the steam to be supplied to the entrance of the nozzle opening 8*a* is adjusted to be in the predetermined range by changing the opening of (the amount of narrowing) the GV 24 as illustrated in FIG. 5. In this case, the main steam pressure is adjusted so that the GV 24 is fully opened when the main steam pressure is the second threshold value; however, since the lower limit of the change width of the main steam pressure is the second threshold value, the change width of the amount of narrowing the opening of the GV 24 may be small. Therefore, the large pressure loss due to the GV 24 that would affect the efficiency of converting into the turbine output can be prevented.

Due to the influence of the geothermal well or the like, the main steam pressure may decrease. When the main steam pressure measured using the pressure gauge 26 is the first threshold value or more and less than the second threshold value, the first steam chest connection valve 21 is opened and the second steam chest connection valve 22 is closed. When the first steam chest connection valve 21 provided to the first steam chest connection pipe 19 is opened and the second steam chest connection valve 22 provided to the second steam chest connection pipe 20 is closed, the steam is supplied from the main steam chest 14 to the first sub-steam chest 15 and the supply of the steam from the main steam chest 14 to the second sub-steam chest 16 is stopped. As a result, the steam chest 31 that the steam can pass is the main steam chest 14 and the first sub-steam chest 15. In this case, similarly, when the main steam pressure measured using the pressure gauge 26 varies in the range of the first threshold value or more and less than the second threshold value, the pressure of the steam to be supplied to the entrance of the nozzle opening 8*a* is adjusted to be in the predetermined range by changing the opening of (the amount of narrowing) the GV 24 as illustrated in FIG. 5. In this case, the change width of the main steam pressure is limited to the range of the first threshold value or more and less than the second threshold value, the change width of the opening (the amount of narrowing) of the GV 24 may be small. Therefore, the large pressure loss due to the GV 24 that would affect the efficiency of converting into the turbine output can be prevented.

When the main steam pressure measured using the pressure gauge 26 is less than the first threshold value, both the first steam chest connection valve 21 and the second steam chest connection valve 22 are opened. When the first steam chest connection valve 21 provided to the first steam chest connection pipe 19 and the second steam chest connection valve 22 provided to the second steam chest connection pipe 20 are opened, the steam is supplied from the main steam chest 14 to both the first sub-steam chest 15 and the second sub-steam chest 16. As a result, the steam chest 31 that the steam can pass is all of the main steam chest 14, the first sub-steam chest 15, and the second sub-steam chest 16. When the main steam pressure measured using the pressure gauge 26 is in the range of less than the first threshold value and the main steam pressure varies, the pressure of the steam to be supplied to the entrance of the nozzle opening 8*a* is adjusted to be in the predetermined range by changing the amount of narrowing the opening of the GV 24 as illustrated in FIG. 5. In this case, the upper limit of the main steam pressure range in which the pressure of the steam to be supplied to the entrance of the nozzle opening 8*a* can be maintained in the predetermined range is less than the first threshold value, and the lower limit thereof is the minimum value at which the steam pressure can be maintained in the predetermined range. Therefore, the change width of the opening of (the amount of narrowing) the GV 24 may be small. Therefore, the large pressure loss due to the GV 24 that would affect the conversion efficiency for the turbine output can be prevented.

In this manner, by adjusting the passing area of the steam chest 31 in the state that the opening of the GV 24 is narrowed as little as possible in the wide main steam pressure range, the pressure of the steam to be supplied to the entrance of nozzle opening 8*a* can be set to be in the predetermined range.

As described above, in the present embodiment, the passing area of the steam chest 31 becomes narrower or larger in stages.

Conventionally, in order to supply the steam to the entrance of the nozzle opening 8*a* with the pressure in the predetermined range even when the main steam pressure varies, the amount of narrowing the opening of the GV 24 is increased when the main steam pressure is high, so that the steam flow rate is decreased and in this case, the pressure loss occurs. Therefore, as shown by a dash-dot line in FIG. 6, even though the main steam pressure is high, the pressure loss of the GV 24 in the main steam pipe 18 is large and the heat drop is suppressed, resulting in that the efficiency of converting into the turbine output is low. On the other hand, in the present embodiment, when the main steam pressure is more than or equal to the second threshold value, the steam chest 31 that the steam can pass is only the main steam chest 14, and the passing area is narrow. As a result, as illustrated in FIG. 5, when the main steam pressure is high, the steam pressure can be adjusted to be in the predetermined range even though the amount of narrowing the opening of the GV 24 is not increased. In addition, since the pressure loss of the GV 24 in the main steam pipe 18 can be reduced, the decrease in efficiency of converting into the turbine output can be suppressed as indicated by the solid line in FIG. 6.

When the pressure of the steam flowing in the main steam pipe 18 is less than the second threshold value, the first steam chest connection valve 21 is opened, and when the pressure of the steam flowing in the main steam pipe 18 is less than the first threshold value, the second steam chest connection valve 22 is opened; thus, the passing area of the steam chest 31 is increased in stages. Therefore, even when the main steam pressure is low, the steam to be supplied to the entrance of the nozzle opening 8*a* can be set to be in the predetermined range.

In addition, since the passing area of the steam chest 31 is changed in stages, the steam pressure can be adjusted to be in the predetermined range without increasing the amount of narrowing the opening of the GV 24 in each range. Further, as indicated by the solid line in FIG. 6, even if the main steam pressure is in the range of the first threshold value or more and less than the second threshold value, the decrease in efficiency of converting into the turbine output can be suppressed.

The capacity of the main steam chest 14 is set so that the provision of the first and second sub-steam chests 15 and 16 does not largely decrease the output of the geothermal turbine 1 and so that the full rated output can be obtained just by the amount of the main steam supplied from this main steam chest 14 to the turbine casing 2. In addition, the capacity of each of the main steam chest 14 and the first and second sub-steam chests 15 and 16 is determined in accordance with the expected range of the main steam pressure or the value of the main steam pressure at which the passing area is changed.

Note that in the case where the angles $\theta_1$ and $\theta_2$ to define the partition walls 10, 11, and 12 are the same and the first sub-steam chest 15 and the second sub-steam chest 16 have the same capacity, when the main steam pressure measured using the pressure gauge 26 is the first threshold value or more and less than the second threshold value, the operation effect is the same in the case where the first steam chest connection valve 21 is opened and in the case where not the first steam chest connection valve 21 but the second steam chest connection valve 22 is opened.

If the angles $\theta_1$ and $\theta_2$ to define the partition walls 10, 11, and 12 are different and the main steam chest 14, the first sub-steam chest 15, and the second sub-steam chest 16 have the different capacities, the passing area of the steam chest 31 can be changed in four steps by setting more threshold values.

For example, when the first sub-steam chest 15 has the smaller capacity than the second sub-steam chest 16 and there are three different threshold values for the main steam pressure, a first threshold value, a second threshold value larger than the first threshold value, and a third threshold value larger than the second threshold value, the following description applies.

When the main steam pressure measured using the pressure gauge 26 is more than or equal to the third threshold value, both the first steam chest connection valve 21 and the second steam chest connection valve 22 are closed. Here, the steam chest 31 that the steam can pass is only the main steam chest 14. When the main steam pressure is the second threshold value or more and less than the third threshold value, the first steam chest connection valve 21 is opened and the second steam chest connection valve 22 is closed. Here, the steam chest 31 that the steam can pass is the main steam chest 14 and the first sub-steam chest 15.

When the main steam pressure is the first threshold value or more and less than the second threshold value, the second steam chest connection valve 22 is opened and the first steam chest connection valve 21 is closed. Here, the steam chest 31 that the steam can pass is the main steam chest 14 and the second sub-steam chest 16. When the main steam pressure is less than the first threshold value, both the first steam chest connection valve 21 and the second steam chest connection valve 22 are opened. Here, the steam chest 31 that the steam can pass is all of the main steam chest 14, the first sub-steam chest 15, and the second sub-steam chest 16.

In the aforementioned embodiment, the three partition walls are provided to divide the turbine steam chest into three; however, the present invention is not limited to this example. In other examples, four or more partition walls may be provided to divide the turbine steam chest into four or more, or two partition walls may be provided to divide the turbine steam chest into two.

The invention claimed is:

1. An operation method for a steam turbine including:

a steam chest casing that has an annular shape surrounding a turbine rotor and is provided with a plurality of nozzle openings along a circumferential direction thereof;

a main steam chest that is provided inside the steam chest casing;

at least one sub-steam chest that is provided inside the steam chest casing and has smaller capacity than the main steam chest;

a partition wall that is provided inside the steam chest casing to partition the steam chest casing into the main steam chest and the sub-steam chest;

a main steam pipe that supplies steam to the main steam chest;

a steam chest connection pipe that connects the main steam chest and the sub-steam chest and distributes part of the steam, which is supplied to the main steam chest, to the sub-steam chest; and a steam chest connection valve that is provided to the steam chest connection pipe, the operation method comprising:

a step of measuring pressure of the steam flowing in the main steam pipe;

a step of closing the steam chest connection valve when the measured pressure of the steam is more than or equal to a predetermined threshold value; and a step of opening the steam chest connection valve when the measured pressure of the steam is less than the predetermined threshold value.

2. The operation method for a steam turbine according to claim 1, wherein:

the at least one sub-steam chest is one of a plurality of sub-steam chests partitioned into by the partition wall;

the steam chest connection pipe is one of a plurality of steam chest connection pipes that connects each sub-steam chest and the main steam chest;

the steam chest connection valve is one of a plurality of steam chest connection valves that is provided to the plurality of steam chest connection pipes; and one or more of the plurality of steam chest connection valves is opened and closed in accordance with the measured pressure of the steam.

3. The operation method for a steam turbine according to claim 1, wherein a governing valve provided to the main steam pipe that supplies the steam adjusts the pressure of the steam at an entrance of the plurality of nozzle openings to be pressure in a predetermined range.

4. The operation method for a steam turbine according to claim 2, wherein a governing valve provided to the main steam pipe that supplies the steam adjusts the pressure of the steam at an entrance of the plurality of nozzle openings to be pressure in a predetermined range.

5. A steam turbine comprising:

a steam chest casing that has an annular shape surrounding a turbine rotor and is provided with a plurality of nozzle openings along a circumferential direction thereof;

a main steam chest that is provided inside the steam chest casing;

at least one sub-steam chest that is provided inside the steam chest casing and has smaller capacity than the main steam chest;

a partition wall that is provided inside the steam chest casing to partition the steam chest casing into the main steam chest and the sub-steam chest;

a main steam pipe that supplies steam to the main steam chest;

a steam chest connection pipe that connects the main steam chest and the sub-steam chest and distributes part of the steam, which is supplied to the main steam chest, to the sub-steam chest;

a steam chest connection valve that is provided to the steam chest connection pipe;

a pressure gauge that measures pressure of the steam flowing in the main steam pipe; and a control unit that closes the steam chest connection valve when the pressure of the steam measured using the pressure gauge is more than or equal to a predetermined threshold value, and opens the steam chest connection valve when the measured pressure of the steam is less than the predetermined threshold value.

6. A steam turbine comprising:

a steam chest casing that has an annular shape surrounding a turbine rotor and is provided with a plurality of nozzle openings along a circumferential direction thereof;

a main steam chest that is provided inside the steam chest casing;

at least one sub-steam chest that is provided inside the steam chest casing and has smaller capacity than the main steam chest;

a partition wall that is provided inside the steam chest casing to partition the steam chest casing into the main steam chest and the sub-steam chest;

a main steam pipe that supplies steam to the main steam chest;

a steam chest connection pipe that connects the main steam chest and the sub-steam chest and distributes part of the steam, which is supplied to the main steam chest, to the sub-steam chest;

a steam chest connection valve that is provided to the steam chest connection pipe; and a closing plate that is provided to the nozzle opening to close the nozzle opening, wherein the partition wall is set at a predetermined angle intersecting with a plate surface of the closing plate.

* * * * *